United States Patent [19]

Chaisson

[11] 4,059,191

[45] Nov. 22, 1977

[54] TIE RACK

[75] Inventor: Maurice J. Chaisson, Athol, Mass.

[73] Assignee: The Raymond Lee Organization, Inc., New York, N.Y.

[21] Appl. No.: 650,947

[22] Filed: Jan. 21, 1976

[51] Int. Cl.[2] ..... A47F 7/12

[52] U.S. Cl. ..... 211/90; 211/13

[58] Field of Search ..... 211/13, 60, 63, 65–67, 211/68, 113, 90, 87–89; 248/108–110

[56] References Cited

U.S. PATENT DOCUMENTS

| | | | |
|---|---|---|---|
| 397,723 | 2/1889 | Jones | 211/66 |
| 1,748,469 | 2/1930 | Desmarais | 211/87 |
| 2,508,945 | 5/1950 | Heuer | 211/75 |
| 2,512,502 | 6/1950 | Paschell | 211/60 R |
| 2,605,000 | 7/1952 | Tomarin | 211/113 |
| 3,349,922 | 10/1967 | Morrison | 211/113 |
| 3,762,570 | 10/1973 | Tobin | 211/13 |
| D. 176,162 | 11/1955 | Steece | 211/87 R |

*Primary Examiner*—Roy D. Frazier
*Assistant Examiner*—Terrell P. Lewis
*Attorney, Agent, or Firm*—Howard I. Podell

[57] ABSTRACT

A tie rack suitable for supporting both conventional neck ties and pre-knotted neck ties. The rack is in the form of a right angle flange, with a first side of the flange fitted with means to mount to a vertical wall or door, so as to extend the second flange side in the horizontal plane. The said second horizontal flange side is formed with pairs of relatively narrow parallel slots extending from an external edge, each slot of a size for supporting a conventional neck tie looped over the finger between said slots of a pair with said pairs of slots each separated by a wide slot that extends further towards the vertical flange side from the horizontal flange edge for supporting a pre-knotted neck tie from the knot. A mirror is mounted on the inside face of the vertical flange.

1 Claim, 5 Drawing Figures

TIE RACK

SUMMARY OF THE INVENTION

My invention is a tie rack suitable for supporting both conventional neck ties and pre-knotted neck ties. The rack is in the form of a right angle flange, with a first side of the flange fitted with means to mount to a vertical wall or door, so as to extend the second flange side in the horizontal plane. The said second horizontal flange side is formed with pairs of relatively narrow parallel slots extending from an external edge, each slot of a size for supporting a conventional neck tie looped over the finger between said slots of a pair with said pairs of slots each separated by a wide slot that extends further towards the vertical flange side from the horizontal flange edge for supporting a pre-knotted neck tie from the knot. A mirror is mounted on the inside face of the vertical flange.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
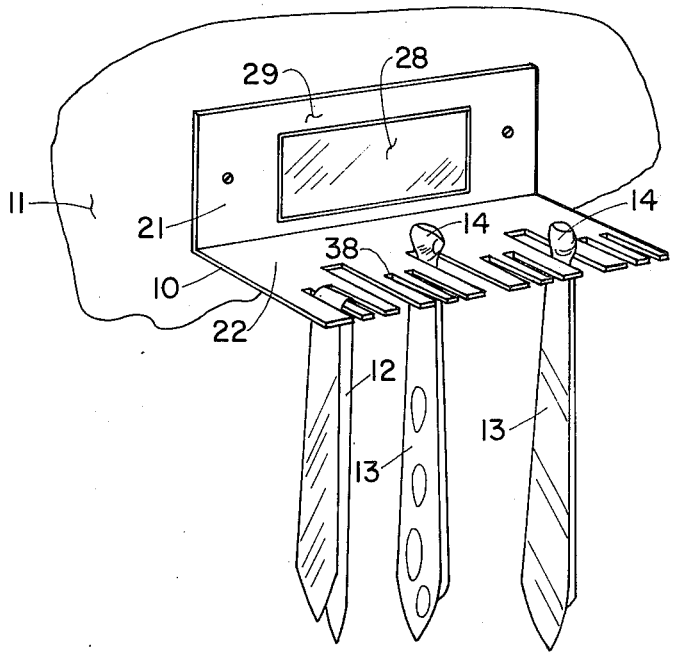
FIG. 1 is a perspective view of the invention in use.
Figure 2:
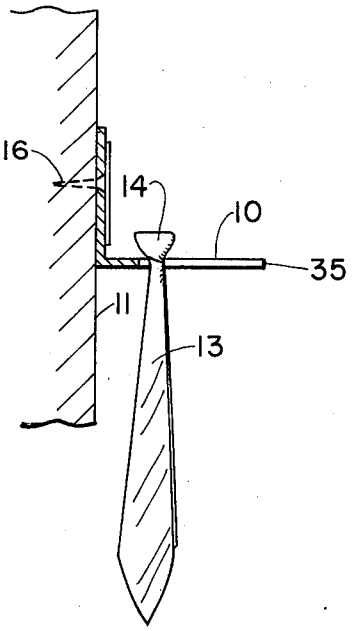
FIG. 2 is a side view of the invention in use.
Figure 3:
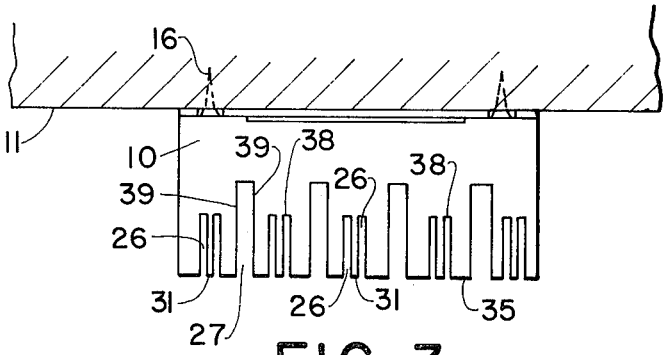
FIG. 3 is a plan view of the invention in use.

Turning now descriptively to the drawings, in which similar reference characters denote similar elements throughout the several views, FIGS. 1–3 illustrate the improved tie rack 10 which may be readily mounted to a vertical surface 11, such as a door or wall, by nails 16 or screws for supporting conventional neck ties 12 and pre-knotted ties 13.

The rack 10 is formed of two flange sides 21 and 22 joined together at right angles, with a first vertical side 21 fitted with mounting holes 25 for nailing to a vertical surface, and the second horizontal side 22 fitted with slots 26 and 27 for supporting neck ties.

A mirror 28 is mounted on the internal face 29 of vertical side 21 facing horizontal side 22 for use in fastening a necktie upon the person of a user.

Slots 26 are formed in pairs, each slot 26 separated by a finger section 31, with slots 26 and finger section 31 being of uniform width and extending from the edge 35 of the horizontal flange side 22.

Each pair of slots 26 are separated from each other by a slot 27, of a greter width and length than slots 26, which also extends from the flange edge 35. Slots 27 are of a width and length to permit hanging of a pre-knotted tie 13 by its knot 14 on the sides 39 of a slot 27, with the knot 14 slid towards vertical flange side 21 beyond an imaginary line joining the inner ends 38 of slots 26 so that a user may have no interference with his fingers in sliding a tie 12 over or off the finger section 31 of a pair of slots 26.

Figure 4:
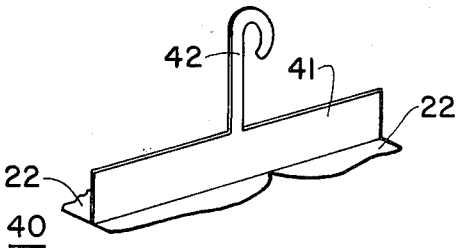
FIG. 4 is a fragmentary perspective view of an alternate embodiment of the invention.

As shown in FIG. 4, vertical side 41 of alternate embodiment 40 may be shaped with a hook section 42 of a size to fit about a horizontal closet pole with one or two horizontal sides 22 joined to vertical side 41.

Figure 5:
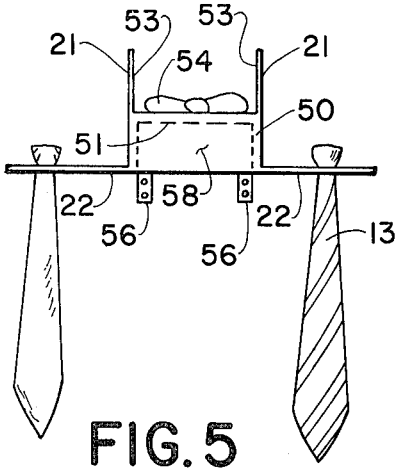
FIG. 5 is an end view of a further alternate embodiment of the invention.

As shown in FIG. 5, tie rack 50 is formed of two spaced racks 10 mounted to an end member 58 with racks 10 oriented back-to-back, with a shelf unit 51 extending between the rear surfaces 53 of vertical sides 21 for supporting one or more bow ties 54. A pair of perforated mounting flanges 56 extend from end member 58 for fastening purposes.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A tie rack assembly for supporting both neckties preformed with knots and conventional neck ties, comprising a rack formed of a first shelf member fitted to a support member, said first shelf member fitted with a plurality of pairs of first slots from an edge of the said shelf member, with a pair of said first slots separated by a second slot.

said second slot of a greater width and depth than the said first slots, said first and second slots bounded by generally parallel walls, with said first slots of a width and spacing suitable for looping a necktie through two adjacent first slots, with the necktie hung by the finger of the shelf member between the two said adjacent first slots, with said second slots each of a size to engage a knotted necktie under the necktie knot, in which two such racks are joined together back-to-back, and separated by a second shelf member of a size to support a bow tie.

* * * * *